United States Patent [19]

Stenemann

[11] Patent Number: 4,623,280

[45] Date of Patent: Nov. 18, 1986

[54] PAVEMENT MARKER APPLICATOR

[75] Inventor: Heinrich F. Stenemann, St. Paul, Minn.

[73] Assignee: Minnesota Mining and Manufacturing Company, St. Paul, Minn.

[21] Appl. No.: 727,337

[22] Filed: Apr. 25, 1985

[51] Int. Cl.[4] ..... E01C 23/16

[52] U.S. Cl. ..... 404/94; 405/176; 156/541

[58] Field of Search ..... 404/93, 94; 221/25, 221/73, 185; 111/1, 3; 405/176, 180; 156/541

[56] References Cited

U.S. PATENT DOCUMENTS

| | | | |
|---|---|---|---|
| 3,086,431 | 4/1963 | Perry, Jr. | 94/39 |
| 3,427,933 | 2/1969 | Taylor-Myers | 94/1.5 |
| 3,453,660 | 7/1964 | Gehweiler et al. | 156/541 X |
| 3,590,701 | 7/1971 | Broeck | 94/39 |
| 3,864,052 | 2/1975 | Blomberg | 404/94 |
| 3,890,191 | 6/1975 | Mayer | 156/541 |
| 4,030,958 | 6/1977 | Stenemann | 156/350 |
| 4,089,730 | 5/1978 | Mahn | 156/541 |
| 4,194,646 | 3/1980 | Oglander et al. | 221/73 |
| 4,242,173 | 12/1980 | Stenemann | 156/523 |
| 4,322,177 | 3/1982 | Eigenmann | 404/93 X |
| 4,560,087 | 12/1985 | Sato et al. | 221/73 |

*Primary Examiner*—Stephen J. Novosad
*Assistant Examiner*—Michael A. Goodwin
*Attorney, Agent, or Firm*—D. M. Sell; J. A. Smith; D. B. Little

[57] ABSTRACT

In the illustrated applicators, one of a series of pavement markers is individually dispensed from a carrier web by stripping the web back from the marker while moving the marker into wedging contact between a spring-loaded roller and the pavement. While doing so, the carrier web is kept taut between a brake shoe where it exits a magazine and an overdriven takeup roll which is locked against rotation while the marker is being moved into the wedging contact. Each pavement marker has a flat base which preferably bears a pressure-sensitive adhesive that releasably adheres the marker to the carrier web and bonds the marker to the pavement.

19 Claims, 7 Drawing Figures

PAVEMENT MARKER APPLICATOR

FIELD OF THE INVENTION

The invention concerns an applicator which mechanically applies discrete pavement markers, especially raised pavement markers.

BACKGROUND ART

Raised pavement markers provide better nighttime and wet delineation of traffic lanes than do painted lines and tapes. In some raised pavement markers, a strip of retroreflective material is adhered to a flap which extends upwardly from a base to face oncoming vehicular traffic. Such raised retroreflective pavement markers are disclosed in Jonnes, U.S. Pat. Nos. 3,785,719 (particularly in FIGS. 6 and 7); May, 4,534,673; and Krech et al., 4,521,129.

An applicator for mechanically applying raised retroreflective pavement markers is disclosed in Blomberg, U.S. Pat. No. 3,864,052. In that applicator, the raised pavement markers are arranged in a stack from which a picker carries the bottom marker by its flap into wedging contact between a pavement-engaging wheel and the pavement. Although the Blomberg applicator was in use for a period of time, it is believed that at the present time, all pavement markers are applied by hand, thus making their use expensive and time-consuming.

Most pavement markers are bonded to the pavement by a 2-part thermosetting resin composition which is deposited onto a freshly cleaned spot on the pavement, after which a pavement marker is positioned on the deposit. Since the cleaning and depositing steps are manual, there may be little advantage to using a machine for mechanically positioning the marker unless the first two steps are also mechanical.

For easy removability, as is desirable in temporary bypasses, some pavement markers bear a layer of pressure-sensitive adhesive for bonding the markers either directly to the pavement or to a pavement-striping tape, as do the markers of the above-cited Jonnes patent. Mechanical application of such markers would save both labor and time. When pavement markers are to be applied to a pavement-striping tape which is being applied mechanically, it would be desirable to apply the markers at the same speed, but this would be difficult and inconvenient if the markers must be applied manually. Machines for mechanically applying pavement-striping tape are disclosed in Stenemann, U.S. Pat. Nos. 4,030,958 and 4,242,173.

DISCLOSURE OF INVENTION

The invention provides an applicator which mechanically applies pavement markers onto pavement (with or without first applying pavement-striping tape) and is of simple, economical construction that should give years of trouble-free operation, because it has no complex components or movements. To be used in the novel applicator, each of the pavement markers has a substantially flat base which is to be adhered to pavement and is releasably adhered to a long, flexible carrier web, there being a single file of uniformly spaced pavement markers along the carrier web. A marker-bearing carrier web may be laid up in Z-fold fashion in a magazine such as a cardboard carton in order to provide a generous supply of the pavement markers.

Briefly, the novel applicator comprises:

a stripper bar positioned close to the pavement and having a substantially horizontal upper face and a small-radius trailing edge;

means for directing the carrier web sequentially across said upper face, around said small-radius edge, and to takeup means;

means for back tensioning the carrier web;

reciprocating means for intermittently advancing the stripper bar and carrier web toward the rear of the applicator and then allowing the stripper bar to be retracted to its original position;

indexing means for positioning one marker after each intermittent advance and retraction of the stripper bar so that its base rests on the carrier web above said upper face, preferably partially overhanging the carrier web and the small-radius edge; and means for pressing the substantially flat base of said one marker against the pavement when that marker is advanced beyond the small-radius edge during the next advancing movement of the reciprocating means.

Each time the stripper bar is reciprocated, one pavement marker is dispensed from the carrier web by stripping the web back from the marker while moving it into wedging contact between the pressing means and the pavement. While doing so and moving the next marker into position, the carrier web is kept taut between the back-tensioning means and the takeup means. The flat base of each pavement marker preferably bears a pressure-sensitive adhesive that releasably adheres the marker to the carrier web and bonds the marker to the pavement.

To operate the novel applicator, a driving force is applied to the reciprocating means which is sufficiently large to advance the stripper bar and with it the carrier web against the braking action of the back-tensioning means. On the other hand, the takeup means should apply to the carrier web a smaller driving force that does not permit the carrier web to overcome the back-tensioning means but keeps the carrier web taut against the stripper bar while it is being retracted.

Preferably the substantially flat base of each pavement marker bears a layer of pressure-sensitive adhesive by which it is adhered to the carrier web and is to be adhered to the pavement, and the carrier web has a release surface to permit the adhesive layer to separate cleanly from the carrier web.

Preferred carrier webs have kraft paper backings which are economical and have good strength. Paper backings may have silicone coatings to provide good release from the adhesive layers. When the pavement markers do not bear an adhesive or bear a normally nontacky adhesive, the carrier web may have a low-tack adhesive layer to keep the markers releasably adhered.

Upon driving the reciprocating means to advance a pavement marker to the position at which its base rests above the upper face of the stripper bar, the pavement marker should overhang the small-radius edge of the stripper bar. Normally several seconds elapse before the stripper bar and carrier web are next advanced, thus providing adequate time for the overhanging portion of the most resilient adhesive-bearing pavement marker to lift gradually from the carrier web. If it failed to do so, the next advance might carry the marker partially around the stripper bar, thus preventing its substantially flat surface from squarely contacting the pavement or pavement-striping tape. If this occasionally happens, the indexing means should be adjusted so that the degree of overhang increases the forces tending to peel the marker from the carrier web. When the base of the marker extends about 2 cm in the longitudinal direction of the carrier web, the overhang preferably is from 4 to 8 mm. The radius of the small-radius edge of the stripper bar should be sufficiently small to assure separation of the pavement markers from the carrier web while being large enough never to cut the carrier web, preferably within the range from 0.5 to 3 mm.

In a preferred prototype of the novel applicator, the takeup means includes a takeup roll on which the carrier web is wound after the markers have been released. In operating that prototype, the takeup roll is locked while the the stripper bar is being advanced, thus advancing the carrier web at twice the speed of the stripper bar. This relatively rapid advance of the carrier web enhances separation of the overhanging marker from the carrier web while moving it toward the pressing means. In the prototype, the pressing means comprise spring-loaded roller means which normally ride on the pavement but retract against their spring loading upon riding over a pavement marker. The spring-loaded roller means should be positioned to begin to wedge the overhanging marker against the pavement while it is being released from the carrier web. Upon releasing the relatively large force advancing the stripper bar, a spring applies said smaller force to retract the stripper bar and rotate the takeup roll, thus taking up the carrier web.

The indexing means may include detent means which are overcome by the large driving force applied to the reciprocating means and the stripper bar. This allows the carrier web to be advanced freely except to the extent it is restrained by the back-tensioning means. The detent means should be adjustable to permit each intermittent advance of the stripper bar and carrier web to advance the carrier web through a distance approximating the spacing between identical points of adjacent markers, after which the detent means re-engage, and the driving force imparted by the takeup means should be insufficient to overcome the detenting.

THE DRAWING

In the drawing which schematically illustrates two prototype applicators of the invention:

Figure 1:
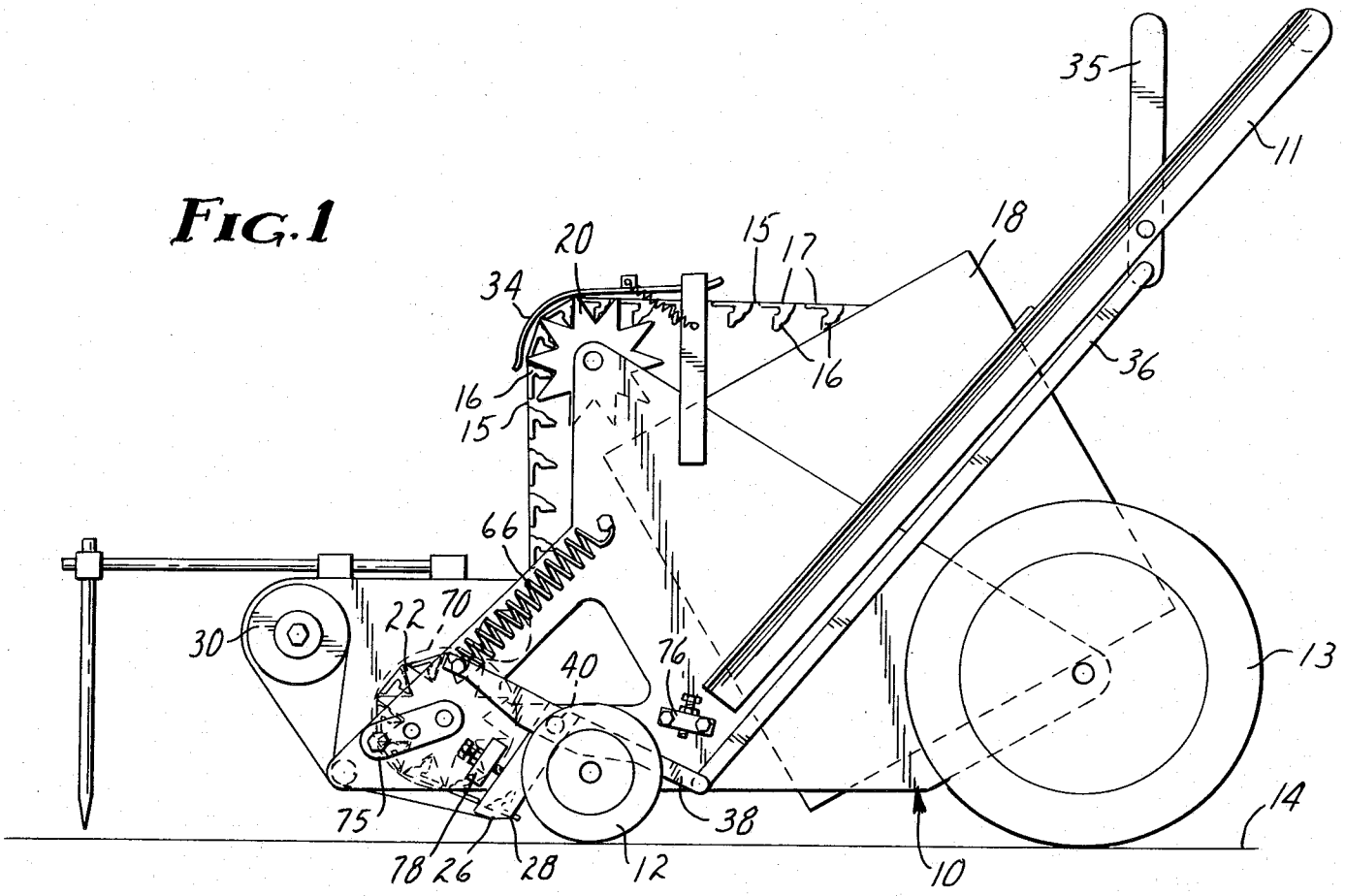
FIG. 1 is a side elevation of a preferred prototype.

The prototype applicator shown in FIGS. 1–5 has a frame 10 including a handle 11 by which it is manually propelled, with two sets of wheels 12 and 13 riding on pavement 14. To a release surface of a carrier web 15, a large number of uniformly spaced, raised pavement markers 16 are adhered by a layer of pressure-sensitive adhesive covering the substantially flat base 17 of each marker. The marker-bearing carrier web is threaded through the applicator from a cardboard carton 18, around a freerolling star wheel 20 and an indexing star wheel 22, across the substantially horizontal upper face 24 of a stripper bar 26, around a trailing, small-radius edge 28 (radius 1.5 mm) of the stripper bar, and is fastened to and wound up on a takeup roll 30. Centering of the carrier web is maintained by a pair of stationary edge guides (not shown), each of which is reversible to accommodate either a 10-cm-wide carrier web or a 15-cm-wide carrier web.

The tips of each of the star wheels 20 and 22 are contacted by the marker-bearing surface of the carrier web 15 while the markers fit loosely into cavities between the tips of the star. A spring-loaded brake shoe 34 rides on the back surface of the carrier web as it travels around the freerolling star wheel 20, thus applying back tension to the carrier web.

Figure 4:
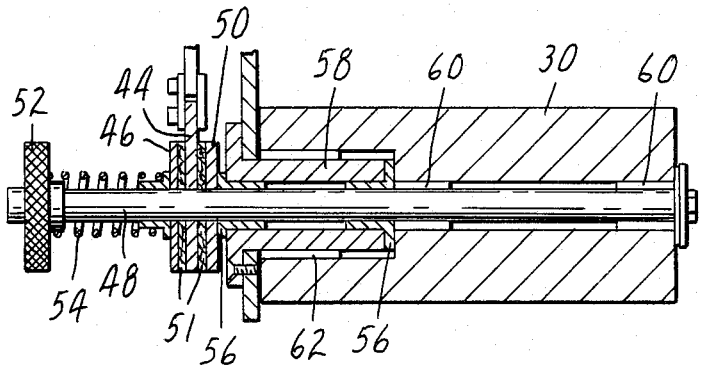
FIG. 4 is a section along line 4—4 of FIG. 2.
Figure 5:
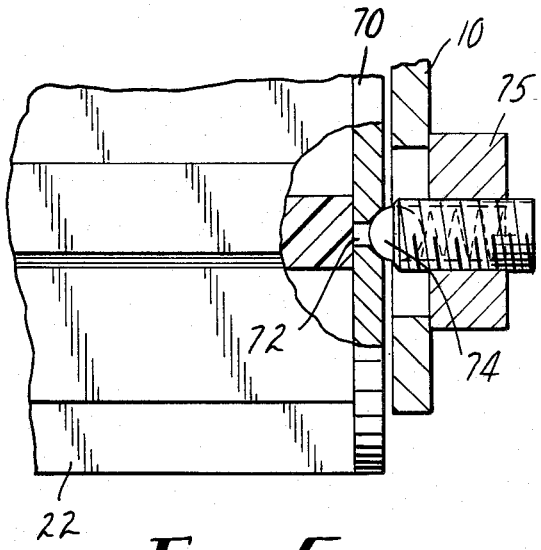
FIG. 5 is a section along line 5—5 of FIG. 3.

At the handle 11 is a lever 35 which when manually pushed forward lifts a pair of pull rods 36, the other end of each of which is pivotably fastened to one end of the crossbar of a T-shaped feed bar 38. At its crossing point, each feed bar is pivotably mounted on a shoulder bolt 40 that is threaded into the frame 10. To the free end of the staff of the feed bar 38 is fixed the stripper bar 26. The other end of the crossbar of the T-shaped feed bar 38 is pivotably attached to a steel driving plate 44 of a slip clutch of the takeup roll 30. As shown in FIG. 4, the slip clutch includes a first steel disk 50 which is integral with a flat-sided central shaft 48, and a second steel disk 46, the central opening of which has flats to lock it to the central shaft. Positioned between the steel disks 46,50 and the driving plate 44 are a pair of friction disks 51 which may be leather, but preferably a synthetic material which performs more uniformly under changing environmental conditions. A knurled nut 52 is threaded to an end of the central shaft to permit adjustment of the force applied to the slip clutch by a compression spring 54. The central shaft 48 is journalled in oil-impregnated bearings 56 of a hollow shaft 58 that is integral with the frame 10. A pair of one-way bearings 60 permit the takeup roll 30 to rotate on the central shaft 48 in only one direction. Another one-way bearing 62 permits the takeup roll to rotate on the hollow shaft 58 only in the opposite direction, thus preventing the carrier web 15 from being unwound from the takeup roll 30.

Figure 2:
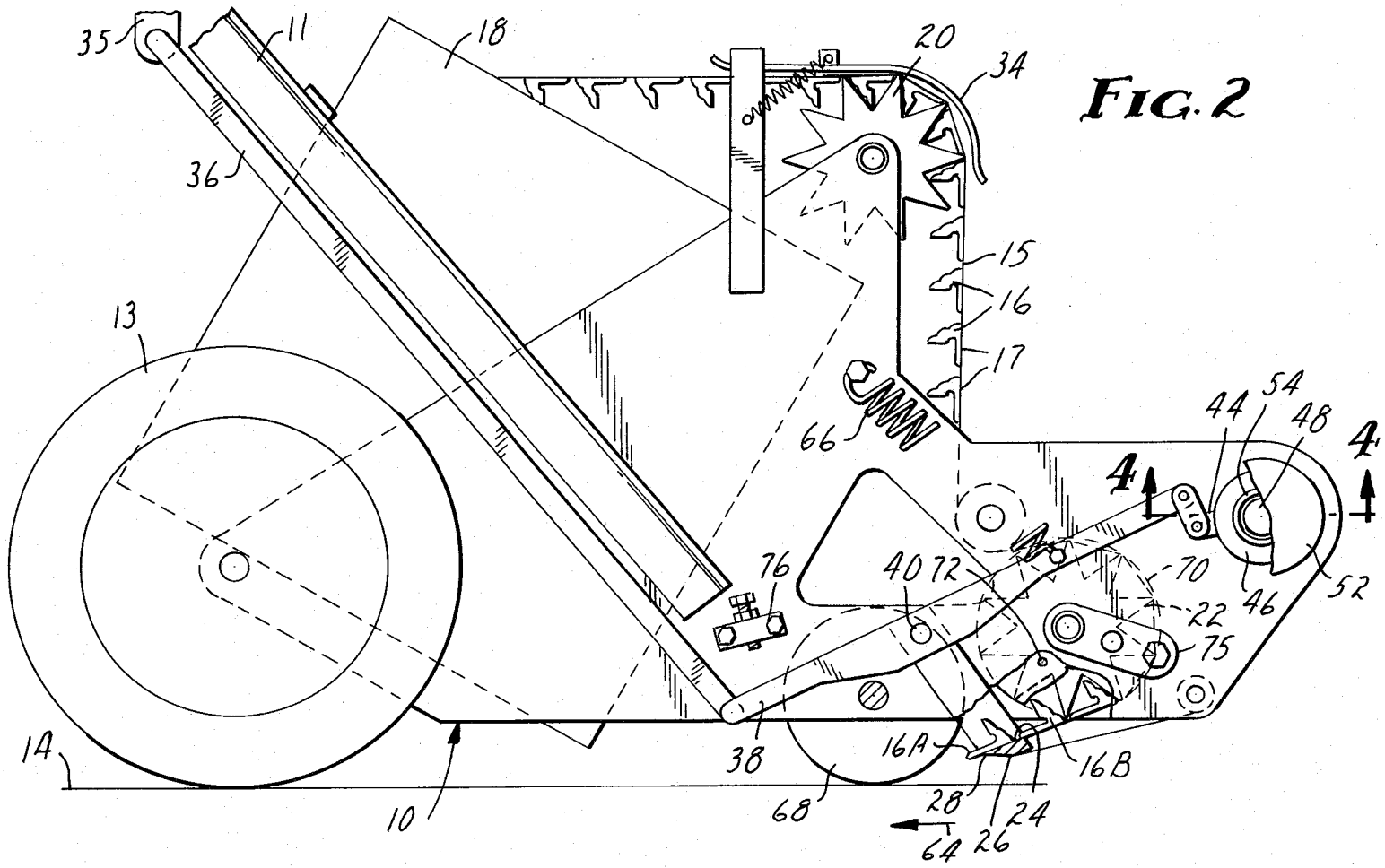
FIG. 2 is a fragmentary side elevation looking at the opposite side of the applicator of FIG. 1, but enlarged and partly cut away to show details.
Figure 3:
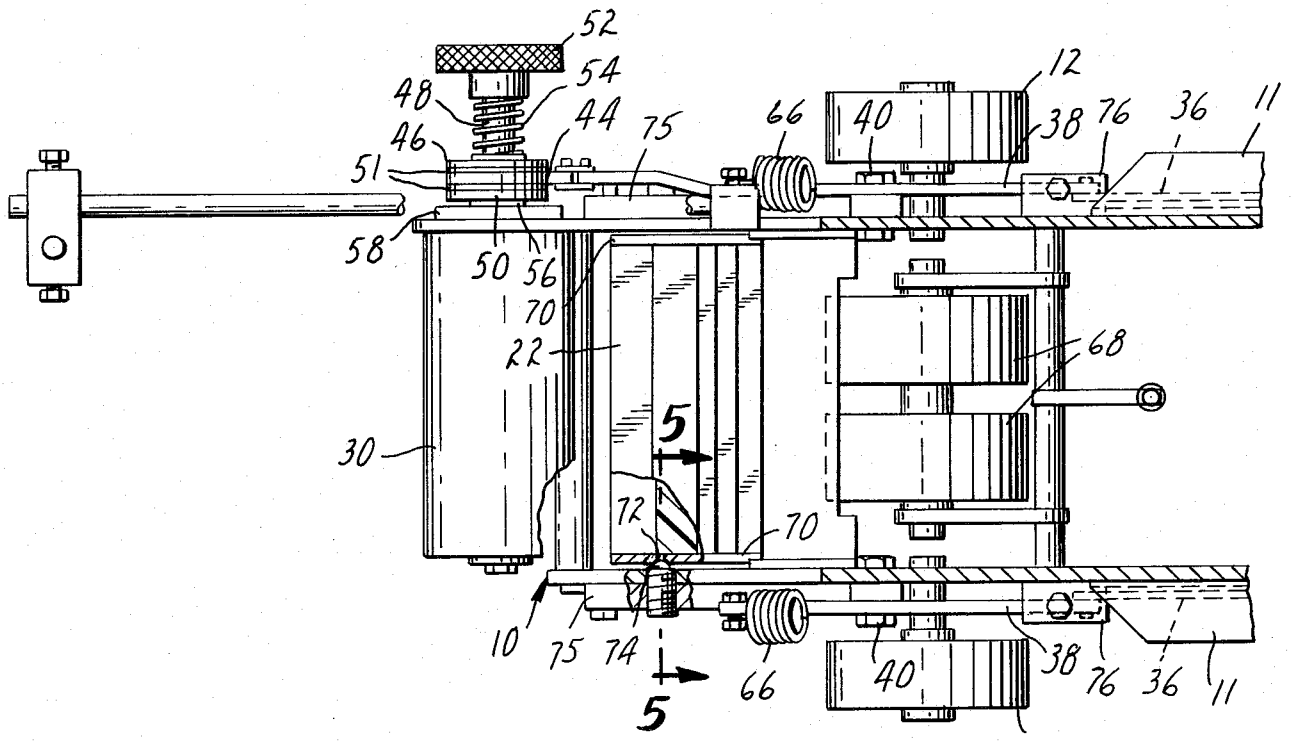
FIG. 3 is a fragmentary top view of the applicator of FIGS. 1 and 2 with the carrier web removed.

When the lever 35 is manually pushed forward, the pull rods 36 pivot the T-shaped feed bars 38 to move the stripper bar 26 rearwardly in the direction indicated in FIG. 2 by the arrow 64. The feed bar also rotates the driving plate 44 counter-clockwise as seen in FIG. 2, but the pair of one-way bearings 60 allow the central shaft 48 to rotate freely within the takeup roll 30. When the operator releases the lever 35, tension springs 66 return the feed bar 38 to its original position, thus retracting the stripper bar 26, and rotating the driving plate 44 clockwise as seen in FIG. 2. This rotates the central shaft 48 in the opposite direction and with it the takeup roll 30, the pair of one-way bearings 60 being locked in this direction.

When the lever 35 is manually pushed forward, the rearward movement of the stripper bar 26 advances the carrier web 15 at twice the speed of the stripper bar. The pavement marker 16A, a portion of which has been overhanging the small-radius edge 28 of the stripper bar 26, is moved rearwardly until it is wedged between spring-loaded application rollers 68 and the pavement 14. When the lever 35 is released, the tension spring 66 retracts the stripper bar 26 and rotates the driving plate 44, and with it the takeup roll 30, thus rolling up a length of the carrier web 15 to bring the next marker 16B into the overhanging position. The pressure applied by the knurled nut 52 has previously been adjusted so that the force applied by the tension spring 66 is sufficient to allow the takeup roll 30 to wind up the carrier web 15 but too small to overcome detent means which are associated with the indexing star wheel 22 and are described in the following paragraph.

Fixed to the indexing star wheel 22 are flanges 70 each of which is formed with small openings 72 having the same radial spacing as do the tips of the indexing star wheel. A spring-loaded plunger 74, carried by a mounting block 75 which is pivotably mounted on the frame 10 at each side of the applicator, fits into the openings 72, thus providing detent means. Adjustment of the angular position of the mounting blocks 75 permits one to adjust the extent to which a pavement marker 16 overhangs the small-radius edge 28 when each plunger 74 is seated in one of the openings 72. Each plunger is adjustably spring-loaded to permit adjustment of the force necessary to overcome the detenting, so that the large driving force manually applied through the lever 35 is sufficient to dislodge the plungers 74, while the smaller force applied to the takeup roll 30 by the tension spring 66 is insufficient to do so. The pavement markers 16 should be securely adhered to the carrier web to prevent the driving of the take-up roll from stripping them from the carrier web 15 while they are restrained in the cavities of the indexing star wheel 22.

The stroke of the lever 35 is limited by a first stop 76 which is adjusted to assure contact between the indexed pavement marker 16B and the application rollers 68, and a second stop 78 is then adjusted so that the stripper bar 26 moves through a distance equal to one-half of the distance between identical points of adjacent pavement markers. The diameter of the take-up roll 30 is selected to insure that it is overdriven when the stripper bar 26 is being retracted, thus assuring no looseness in the carrier web 15.

Figure 6:
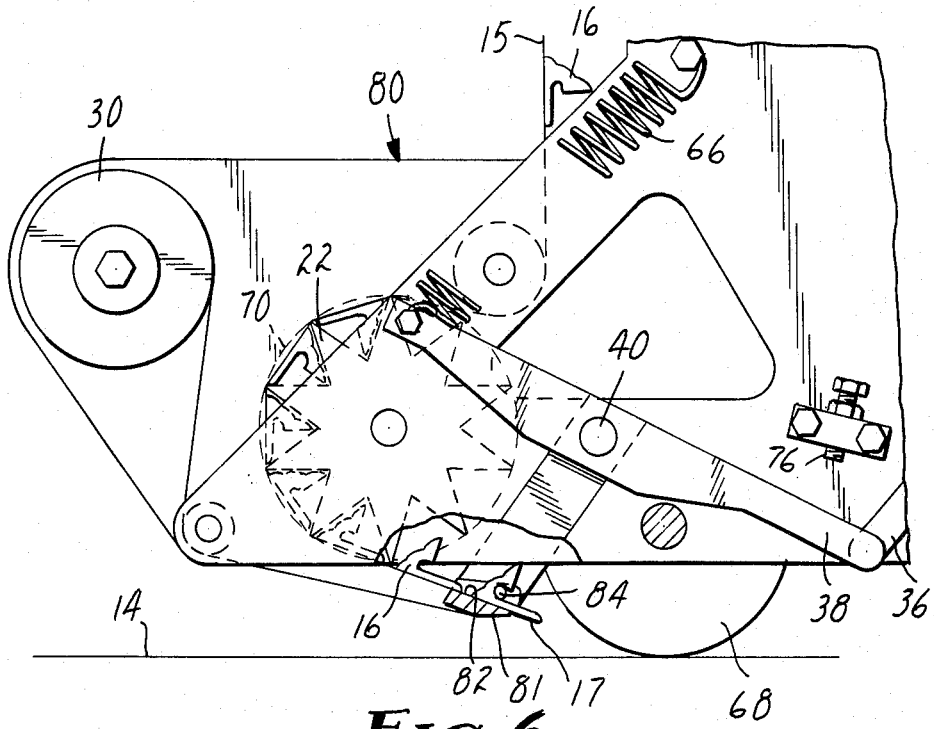
FIG. 6 is a side elevation of a fragment of a second prototype, partly cut away to show details.
Figure 7:
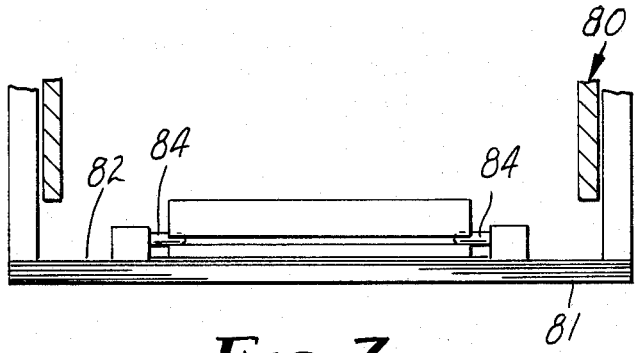
FIG. 7 is an enlarged end view showing the stripper bar of the second prototype.

Reference is now made to FIGS. 6 and 7 which show a second applicator 80 which differs from the applicator of FIGS. 1–5 only in the indexing means. Hence, the same reference characters are used for unchanged elements. To be used in the applicator 80, the pavement markers 16 must be highly resilient, e.g., spongelike, as are the preferred pavement markers of the two above-cited U.S. patents. The applicator 80 has a stripper bar 81 which has a substantially horizontal upper face 82, at the ends of which are a pair of pins 84 that fit into recesses in the pavement markers 16. The pins serve to stop the carrier web 15 while it is being wound on the takeup roll and hence should be adjustable to provide the desired degree of overhang. Then upon retracting the stripper bar 81, the ends of the marker 16 are bent to slide past the pins 84, thus freeing the marker to allow it to be wedged by the application rollers 68 into engagement with the pavement 14.

In using the applicator 80, the windup force applied to the carrier web 15 should be less than that required to pull a marker past the pins 84.

I claim:

1. Applicator which mechanically applies pavement markers, each having a substantially flat base which is to be adhered to pavement and is releasably adhered to a flexible carrier web, there being uniform spacing between the pavement markers along the carrier web, said applicator comprising:

a stripper bar positioned close to the pavement and having a substantially horizontal upper face and a small-radius trailing edge;

means for directing the carrier web sequentially across said upper face, around said small-radius edge, and to takeup means;

means for back tensioning the carrier web;

reciprocating means for intermittently advancing the stripper bar and carrier web toward the rear of the applicator and then allowing the stripper bar to be retracted to its original position;

indexing means for positioning one marker after each intermittent advance and retraction of the stripper bar so that its base rests on the carrier web above said upper face; and means for pressing the substantially flat base of said one marker against the pavement when that marker is advanced beyond the small-radius edge during the next advancing movement of the reciprocating means.

2. Applicator as defined in claim 1 including means for applying a large driving force to the reciprocating means to advance the stripper bar and with it the carrier web, and the takeup means includes means for applying a smaller force to retract the stripper bar and to take up the carrier web.

3. Applicator as defined in claim 2 wherein the takeup means includes an overdriven takeup roll on which the carrier web is wound.

4. Applicator as defined in claim 3 including means for locking the takeup roll while the reciprocating means is advancing the stripper bar and carrier web, and for rotating the takeup roll to take up the carrier web while the stripper bar is being retracted.

5. Applicator as defined in claim 4 wherein said takeup roll is rotatably mounted on a shaft and includes means including a slip clutch for applying said large driving force to rotate the shaft in one direction without rotating the takeup roll and for applying said smaller force to rotate the shaft in the opposite direction to rotate the takeup roll.

6. Applicator as defined in claim 5 wherein the slip clutch means include a one-way roller bearing allowing the shaft to rotate freely within the takeup roll when the shaft is rotated in said one direction and locking the takeup roll to the shaft when the shaft is rotated in said opposite direction.

7. Applicator as defined in claim 2 wherein said indexing means includes an indexing star wheel, the tips of which are contacted by the marker-bearing surface of the carrier web while the markers fit loosely into cavities between the tips of the star so that movement of the carrier web and markers rotates the indexing star wheel.

8. Applicator as defined in claim 7 including detent means for controlling the angular position of the indexing star wheel at the conclusion of each advancing movement of the stripper bar.

9. Applicator as defined in claim 8 wherein the detent means are adjustable to control the extent of the partial overhang of the marker base at the conclusion of each advancing movement of the stripper bar.

10. Applicator as defined in claim 9 wherein the detent means comprises a spring-loaded plunger and a flange which is fixed to the star wheel and formed with openings into which the plunger fits, the openings having the same spacing as do the tips of the indexing star wheel.

11. Applicator as defined in claim 10 wherein the plunger is adjustably fixed to the frame to permit adjustment of the extent of overhang of the marker base at the conclusion of each advancing movement of the stripper bar.

12. Applicator as defined in claim 7 wherein said back-tensioning means includes a freerolling star wheel, the tips of which are contacted by the marker-bearing surface of the carrier web while the markers fit into cavities between the tips of the star so that movement of the carrier web and markers rotates the freerolling star wheel.

13. Applicator as defined in claim 12 wherein said back-tensioning means includes a brake shoe which rides against the back surface of the carrier as it travels around the freerolling star roller.

14. Applicator as defined in claim 7 wherein said pavement markers are resilient, said indexing means includes a pair of pins fixed to the stripper bar which contact the ends of a pavement marker, and said large driving force is sufficient to force a marker past the pins while said smaller force is not.

15. Applicator as defined in claim 1 wherein the pressing means comprise spring-loaded roller means which normally ride on the pavement but retract against their spring loading upon riding over a pavement marker.

16. Applicator as defined in claim 15 wherein the spring-loaded roller means are positioned to wedge the overhanging marker against the pavement while the marker is being released from the carrier web.

17. Applicator as defined in claim 1 which further comprises a magazine from which the carrier web is supplied to said means for directing the carrier web, said magazine being capable of holding a length of said carrier web.

18. Applicator as defined in claim 17 wherein the magazine is a cardboard carton.

19. Applicator as defined in claim 1 wherein the radius of said small-radius edge is from 0.5 to 3 mm.

* * * * *